United States Patent [19]

Schieser et al.

[11] 4,308,955

[45] Jan. 5, 1982

[54] INTERFITTING, STACKABLE BOTTLES

[75] Inventors: Warren J. Schieser, Dublin; Craig L. Duffey, Galena, both of Ohio

[73] Assignee: Liqui-Box Corporation, Worthington, Ohio

[21] Appl. No.: 153,086

[22] Filed: May 27, 1980

[51] Int. Cl.[3] ..... B65D 21/02; B65D 1/02

[52] U.S. Cl. ..... 206/509; D9/408; D9/411; 215/1 C; 215/10; 220/72

[58] Field of Search ..... 206/509, 511, 512; 215/1 C, 10; 220/72; D9/408, 411

[56] References Cited

U.S. PATENT DOCUMENTS

| | | | |
|---|---|---|---|
| D. 203,884 | 2/1966 | Wood | D9/411 |
| D. 207,745 | 5/1967 | Linn | D9/408 |

FOREIGN PATENT DOCUMENTS

| | | | |
|---|---|---|---|
| 1432186 | 4/1969 | Fed. Rep. of Germany | 215/1 C |
| 1406534 | 6/1965 | France | 215/10 |
| 2395905 | 3/1979 | France | 220/23.4 |
| 535917 | 4/1941 | United Kingdom | 215/10 |

*Primary Examiner*—George E. Lowrance
*Attorney, Agent, or Firm*—William V. Miller

[57] ABSTRACT

A large light-weight bottle made of plastic of the type used on water dispensers instead of the heavy glass bottle. Each bottle is made of rectangular or square transverse cross-section with spaced reinforcing ribs or bands extending therearound. On opposed flat faces or sides, each bottle is provided, respectively, with a square locking projection and a complemental receiving socket so that a plurality of the bottles can be stacked on their sides with the locking projections and sockets of adjacent sides interfitting to keep the bottles in alignment in the stack and with the reinforcing ribs superimposed for strength.

6 Claims, 10 Drawing Figures

17
16a
16
15
26a
26
33
27
24
31
26b
21
25

INTERFITTING, STACKABLE BOTTLES

BACKGROUND, PRIOR ART AND BRIEF DESCRIPTION OF THE INVENTION

In U.S. Pat. No. Des. 244,427 there is disclosed a large plastic water bottle of circular transverse cross-section with reinforcing ribs or bands extending therearound. This bottle has met with considerable favor in replacing the heavy glass water bottles previously used. However, because of the thin plastic walls of the bottles, it is necessary to place them in wooden crates to protect them and for stacking during storage and delivery which, obviously, is quite costly. Furthermore, these crates do not interlock to keep a stack straight.

The present invention provides a water bottle of the general type indicated made of thin plastic, such as polycarbonate, which is strong and capable of being stacked and handled during storage and delivery without being protected by wooden crates or the like. To accomplish this, the bottle is made of square or rectangular transverse cross-section with reinforcing bands or ribs extending therearound. On opposed flat sides, each bottle is provided with a locking projection or tenon of square form and a complemental socket or mortise of square form, respectively. This makes it possible to stack a plurality of the bottles on their sides with the adjacent bottle sides in contact and with the tenons and mortises thereof interfitting to keep the stack straight. The interfitting tenons and mortises also locate the reinforcing ribs of the adjacent bottles of the stack so that they are in vertical alignment and rest on each other to maintain the strength of each bottle in the stack. Consequently, with this arrangement it is not necessary to enclose each bottle in an expensive crate for storage or delivery. The quadrangular cross-section, preferably rectangular, of the bottle provides for better space utilization in warehousing and delivery as compared to the bottles of circular cross-section. The angular bottles are easier to carry on the shoulder in delivery and do not tend to roll off. Also stress on the flat surfaces of the plastic bottle is distributed better as compared to that on curved surfaces.

BRIEF DESCRIPTION OF THE DRAWINGS

The best mode contemplated on carrying out this invention is illustrated in the accompanying drawings in which.

DETAILED DESCRIPTION OF THE INVENTION

Figure 8:
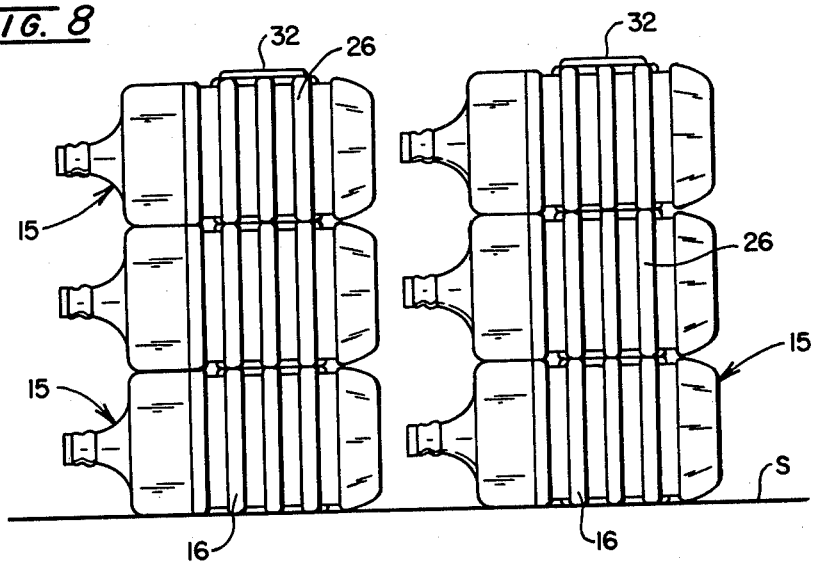
FIG. 8 is a schematic view showing the bottles stacked on a flat surface.
Figure 9:
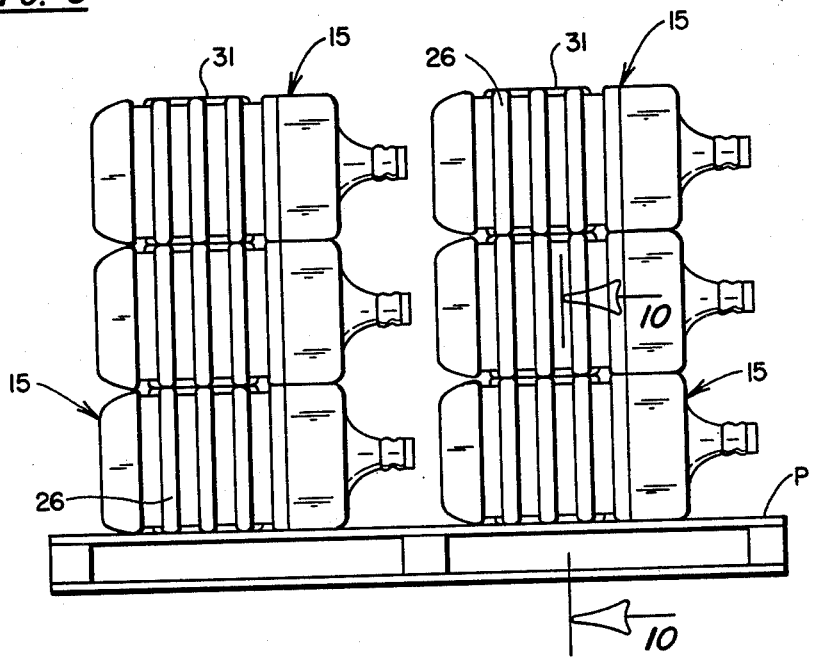
FIG. 9 is a similar view showing them stacked on a pallet.
Figure 10:
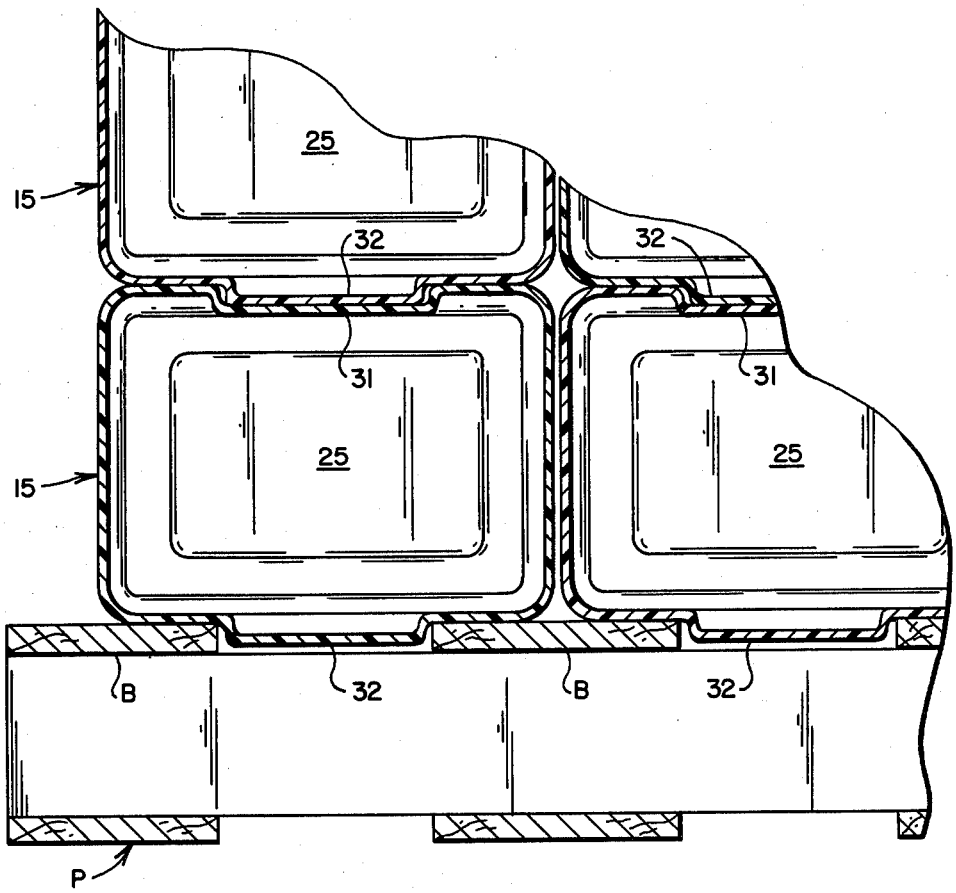
FIG. 10 is an enlarged vertical sectional view taken along line 10—10 of FIG. 9.

With specific reference to the drawings the bottle is shown upright in the position it will be filled in FIGS. 1 to 3, 6, and 7 and on its side as it will be stacked in either FIG. 8 or FIGS. 9 and 10.

The bottle, as indicated, is made of thin plastic material by blowmolding, preferably of polycarbonate. It will, consequently, be of very light weight having thin walls but it will be so formed that it will have adequate strength. Also, the bottle will have at least two opposed straight or flat sides so a plurality of the bottles can be stacked and the adjacent contacting sides will have interfitting portions.

Figure 1:
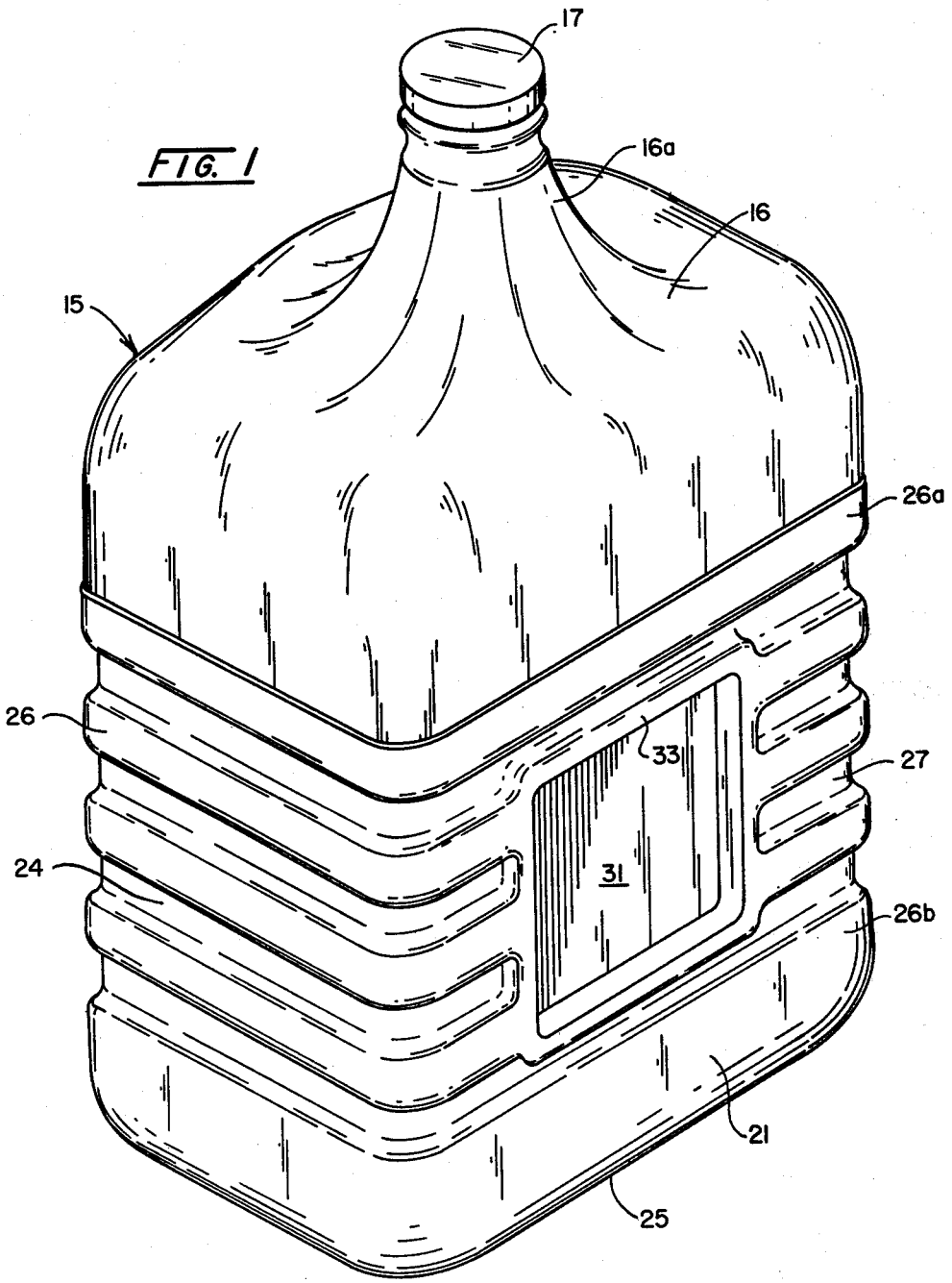
FIG. 1 is a perspective view of a bottle embodying this invention.
Figure 3:
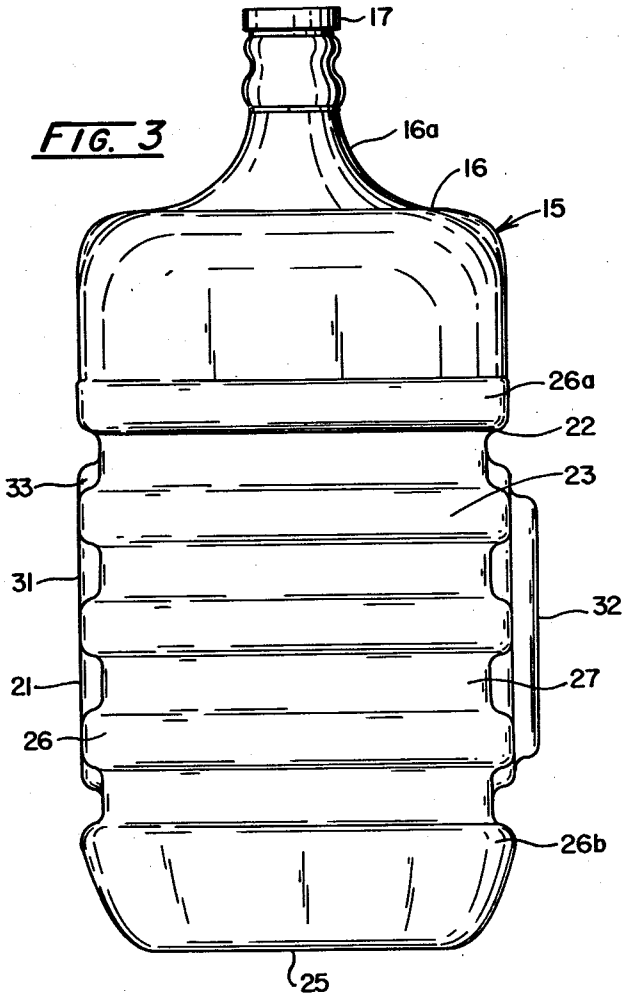
FIG. 3 is an elevational view of one narrow side of the bottle.
Figure 2:
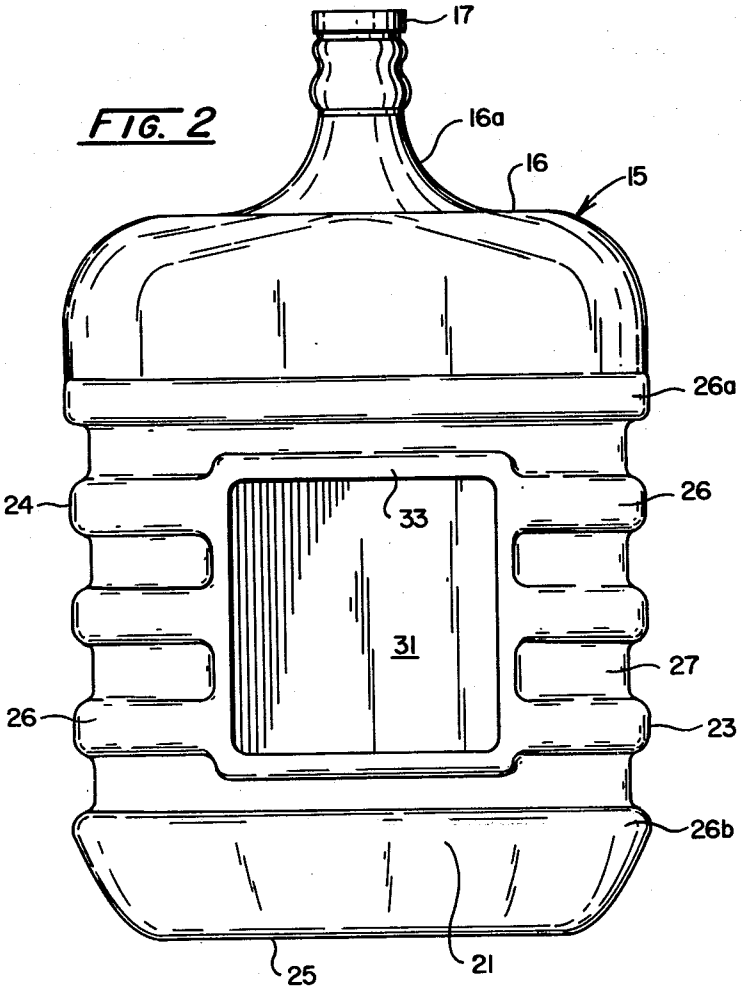
FIG. 2 is an elevational view of one wide side of the bottle.
Figure 4:
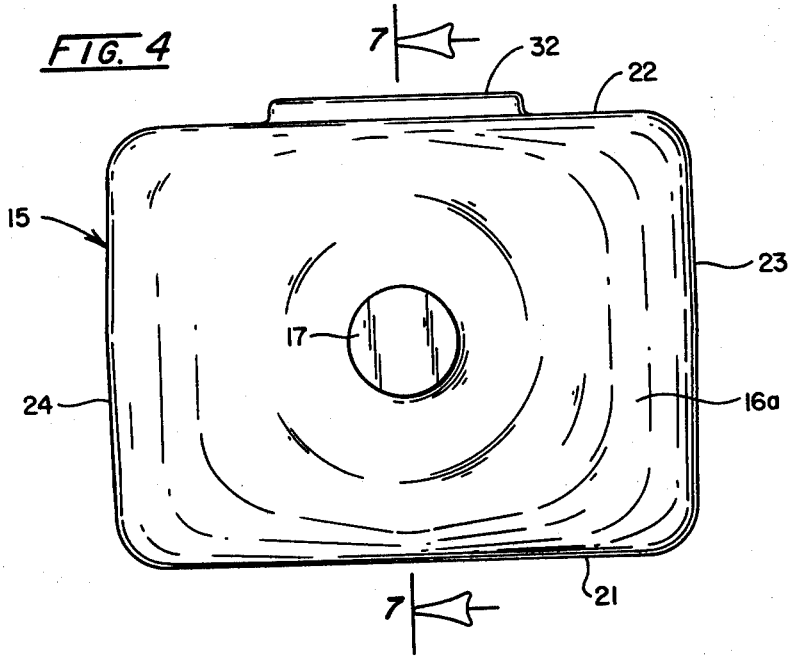
FIG. 4 is a top view of the bottle.
Figure 5:
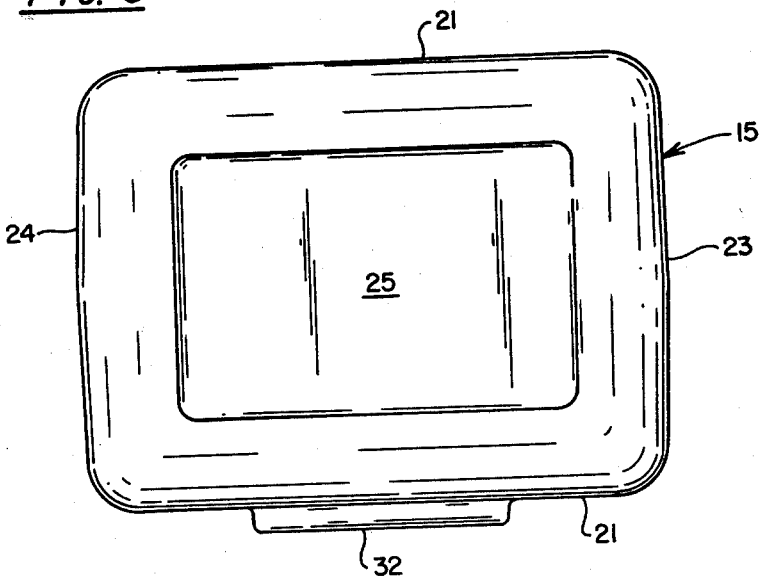
FIG. 5 is a bottom view of the bottle.
Figure 7:
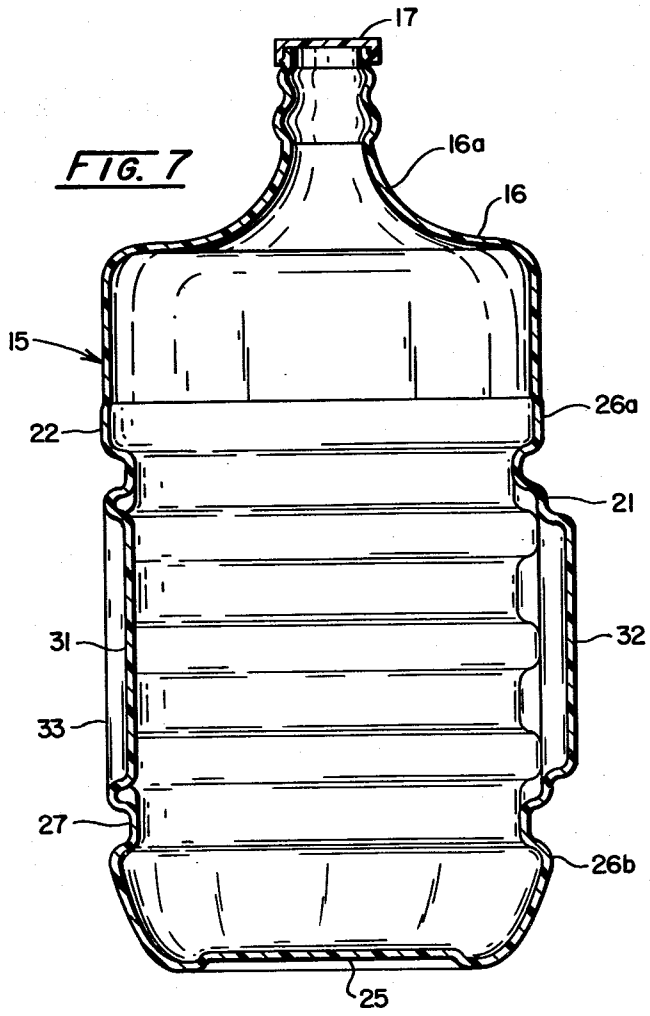
FIG. 7 is a vertical sectional view taken along line 7—7 of FIG. 4.
Figure 6:
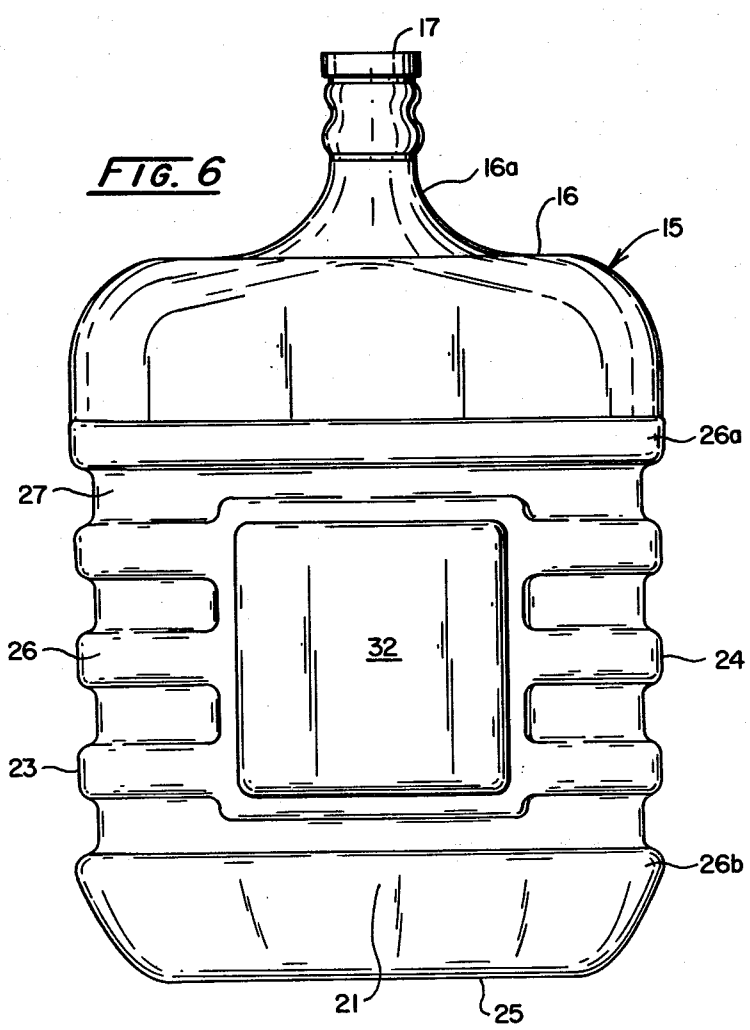
FIG. 6 is an elevational view of the other wide side of the bottle.

As shown in FIG. 1, the bottle consists of a body 15 with an upstanding tapered neck **16*a*, on top 16, which may receive a threaded cap 17** or other suitable closure.

The body 15, as indicated in FIGS. 2 to 7, is formed so that it is of quadrangular cross-section, preferably rectangular. Consequently, there are provided four sides or walls which are vertical or upright when the bottle is in the filling position illustrated in these Figures. These sides are the one wide side or face 21, the opposed wide side 22 and the two narrower sides 23 and 24, which are upstanding from a recessed bottom 25.

In order to give the side walls adequate strength, embossed reinforcing ribs or bands 26 are formed on the walls and alternate vertically with grooves 27. To facilitate stacking and maintaining the stacks straight, the bottles at their opposed wider walls 21 and 22 are provided with cooperating centrally disposed mortises and tenons. Thus, in wall 21 a mortise 31 is formed and in the opposed wall 22, a tenon 32 is formed. The mortise 21 is in the form of an angular, preferably a square socket and the border of the socket is formed by an embossed rib 33 integrally joined to the ribs 26 and it also forms a part of the wall reinforcement. The inner surface of the socket 31 is smooth and flat. The tenon 32 is in the form of an angular, preferably a square projection which projects outwardly beyond the ribs 26 and is of a size and depth complemental to that of the mortise. It has a smooth outer planar surface. It is integrally joined to the adjacent bands 26.

It will be noted that the three intermediate reinforcing ribs or bands 26 extend completely horizontally around the body 15 except where they are interrupted by the mortise or socket 31 and the tenon or locking projection 32, but these portions are so formed and joined to the bands as to serve as wall reinforcement.

The uppermost reinforcing band **26*a* extends completely around the body 15. The lowermost reinforcing band 26*b* extends completely around the body 15 and merges with the bottom 25**.

When in use, the bottle can be filled in upright position through the neck **16*a* by the usual filling equipment. The mortise or socket 31 in the side is a convenient place to apply a product label. When the bottle is used on the water dispenser, it is inverted and supported thereon in the usual manner. Although the body of the bottle is quadrangular, its tapered neck 16*a* is of circular cross-section and merges with the relatively flat top 16** which provides a flat bearing surface that will rest on the support ring of the reservoir of the standard dispenser cabinet, even though those rings do vary in diameter within limits. Of course, the bottle is not limited to this particular use.

A plurality of the bottles can be readily stacked on their sides as indicated in FIGS. 8 to 10. Adjacent straight sides of the stacked bottles will have the cooperating mortises 31 and tenons 32 interfitting and interlocking to prevent relative displacement horizontally in any direction.

The stacking may start with the lowermost bottle resting on the mortise side 21, if the stack is to be supported by a flat surface S, as in FIG. 8, or on the tenon side 22 if it is to rest on and interlock with a support such as the pallet P shown in FIG. 9. In the latter case, the tenon 32 of the lowermost bottle may interlock with the board slats B of the pallet in either one or both directions to prevent horizontal displacement of each stack on the pallet. It will be noted that the mortise and tenon arrangement interlocks adjacent bottles so that the reinforcing ribs 26, etc. are superimposed. This resting of the ribs on each other in the stack maintains the strength of all the bottles while stacked.

It will be apparent that this invention provides a large water bottle which is of plastic and very light but which is reinforced. It provides a bottle of quadrangular cross-section, preferably rectangular, to provide straight stacking sides, with opposed sides carrying a locking projection and socket, respectively. When stacked, adjacent projections and sockets will serve as mortises and tenons to maintain the stack. Also, these interfitting locking portions will locate the reinforcing ribs of the respective bottles so that they stack on each other to maintain the individual bottle strength in the stack. Also, if a pallet is used to handle the bottles, the lowermost bottle of each stack may interlock with it. This stacking and interlocking makes storage and handling possible without first crating each bottle in an expensive crate. The angular cross-section of the body of the body also provides for better space utilization and handling but its flat bearing surface around the neck of circular cross-section makes it possible to mount it on standard dispensers.

Having thus described this invention what is claimed is:

1. A bottle having a hollow body including at least two opposed straight sides, one of the sides having at least one mortise in its surface and the other a complemental tenon on its surface so that when a plurality of the bottles are stacked on their sides the mortise and tenon at adjacent sides interfit, said body also having reinforcing embossed ribs on the surfaces of said sides which alternate axially with grooves formed therein, the mortises and tenons of adjacent sides of the bottles when stacked on their sides interlocking and serving to also locate the reinforcing ribs axially in alignment so that they are in superimposed contacting relationship to prevent undue distortion of the hollow stacked bodies.

2. A bottle according to claim 1 in which the body is of quadrangular cross-section, the tenon is in the form of an angular projection located on the one straight side and the mortise is in the form of a complemental angular socket on the opposite side.

3. A bottle according to claim 2 in which the reinforcing ribs are on the form of embossed bands extending around the body with some joining integrally with the socket and projection.

4. A bottle according to claim 1 in which the hollow body has an upper tapered neck end of circular cross-section merging with a relatively flat top bearing surface.

5. A bottle according to claim 4 in which the hollow body has a bottom, the bottom merging with a reinforcing band extending completely around the body, and at least one reinforcing band being provided toward the neck end above the mortise and tenon and extending completely around the body.

6. A stack of bottles according to claim 5 in combination with a pallet having spaced slats, the lowermost side of the lowermost bottle in the stack resting on the pallet and having its tenon interfitting within the slats of the pallet.

* * * * *